US005794483A

United States Patent [19]

Haushalter et al.

[11] Patent Number: 5,794,483

[45] **Date of Patent: *Aug. 18, 1998**

[54] ANGLED BLADE TOOLING FOR A FIN MACHINE

[75] Inventors: Mark F. Haushalter, Bellefontaine; David L. Haushalter, Kenton, both of Ohio

[73] Assignee: Robinson Fin Machines, Inc., Kenton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 721,610

[22] Filed: Sep. 25, 1996

[51] Int. Cl.[6] ..... B21D 5/16; B21D 13/02

[52] U.S. Cl. ..... 72/379.6; 72/385; 72/476

[58] Field of Search ..... 72/305, 476, 478, 72/379.6

[56] References Cited

U.S. PATENT DOCUMENTS

| | | | |
|---|---|---|---|
| 1,006,811 | 10/1911 | Walsh | 72/385 |
| 4,736,518 | 4/1988 | Golden et al. | 72/385 |
| 5,263,355 | 11/1993 | Malagnoux | 72/385 |

FOREIGN PATENT DOCUMENTS

| | | | |
|---|---|---|---|
| 221619 | 12/1983 | Japan | 72/385 |
| 264221 | 11/1988 | Japan | 72/385 |
| 995982 | 2/1983 | U.S.S.R. | 72/385 |

*Primary Examiner*—David Jones
*Attorney, Agent, or Firm*—Barbara Joan Haushalter

[57] ABSTRACT

A fin forming device folds fin material into a plurality of corrugations by creating a fold radius at each fold. The device comprises a substantially rectangular plane of metal having a front side, and an opposing back side. The perimeter of the plane is defined by a top edge which is applied to the fin material to form the fold radius, a bottom edge, and a pair of opposing side edges. Initially, each of the edges has a substantially similar thickness. An angled surface is created on at least one side of the plane, commencing in an interior area of the plane below the top edge of the plane and terminating at the top edge of the plane. This creates an angled blade surface along at least a portion of the top edge of the plane. The angled blade surface has a narrower thickness than the initial edge thickness.

8 Claims, 1 Drawing Sheet

ANGLED BLADE TOOLING FOR A FIN MACHINE

BACKGROUND OF THE INVENTION

The present invention relates to finned heat transfer devices and products and, more particularly, to tooling designed to form fin for use in high density applications, particularly those having small cubic volume space restrictions, whereby the tooling is usable on a self-feeding continuous forming device, such as is known in the industry as a Robinson fin machine.

Various types of apparatus are known in the art for forming, crimping, folding, perforating, and otherwise processing, sheet or strip material, such as sheet metal. One such apparatus is a rolling fin machine utilizes a gear mesh operation to form fin as the fin material passes between the two gears. Another type is the reciprocating press fin machine, such as the Robinson fin machine. Heat transfer devices, such as heat sinks and heat exchangers, are widely used for absorptive thermal protection. To achieve this, heat transfer devices are made of various types of corrugated fin material to allow energy transfer during passage of air and/or fluid through the device. Multiple fin segments of different configuration may be provided to direct the flow through the devices.

It is known in the art that heat transfer can be improved in various applications by increasing the surface area of the fin material. Various factors affect the design of a given fin array, including spacing between fins, fin thickness, and fin material. Hence, the surface area of the fin material can be increased by either increasing the height of the fin material; increasing the number of fins per inch of the fin material; or increasing the width or flow length of the fluid along the fin. However, each of these improvements has tangible limits. For example, the part incorporating the fin material typically has a height and width limitation, which the fin material must adhere to in order to fit in the part. This is particularly the case with compact parts such as medical equipment, space applications, and computers, where increasing the size of the fin material and, therefore, the heat transfer device, is extremely undesirable. Additionally, increases in the height of the fin material does not create a directly proportional increase in the performance or efficiency of the heat transfer device.

Increasing the number of fins per inch is theoretically sound, but, often, realistically limited. The number of fins per inch is limited by the performance and ability of the corrugation means that forms the fin segments in the fin material. The spacing between fins is directly affected by the tooling means for forming the corrugations. The tighter the corrugations, the closer the spacing between fins, and the greater the heat transfer capability. However, existing fin forming tooling has a uniform thickness, realistically limiting the closeness of the corrugations. Achieving tighter corrugation measurements has often resulted in the use of progressively thinner material, which can be less apt to maintain its form.

It is seen then that there exists a need for a fin forming means which can achieve closer corrugations without requiring a proportional decrease in material thickness.

SUMMARY OF THE INVENTION

This need is met by the angled blade tooling according to the present invention, which provides for more compactly spaced corrugations in relatively thicker fin material. This, in turn, improves the heat transfer capability of the heat transfer device incorporating the fin material. Generating fin according to the present invention provides a fin material having closely spaced corrugations, without sacrificing any thickness in material.

In accordance with one aspect of the present invention, a fin forming device folds fin material into a plurality of corrugations by creating a fold radius at each corrugation fold. The device comprises a substantially rectangular plane of metal having a front side, and an opposing back side. The perimeter of the plane is defined by a top edge which is applied to the fin material to form the fold radius, a bottom edge, and a pair of opposing side edges. Initially, each of the edges has a substantially similar thickness. An angled surface is created on at least one side of the plane, commencing in an interior area of the plane below the top edge of the plane and terminating at the top edge of the plane. This creates an angled blade surface along at least a portion of the top edge of the plane. The angled blade surface has a narrower thickness than the initial edge thickness.

Accordingly, it is an object of the present invention to provide an improvement in the thermal performance of a heat transfer device. It is also an object of the present invention to provide such an improvement by positively affecting the fin formation of the heat transfer device. It is a further object to provide such an improvement wherein the number of fins per inch of the fin material is increased without a corresponding decrease in the thickness of the material.

Other objects and advantages of the invention will be apparent from the following description, the accompanying drawings and the appended claims.

DETAILED DESCRIPTION OF THE PREFERRED EMBODIMENTS

Figure 1:
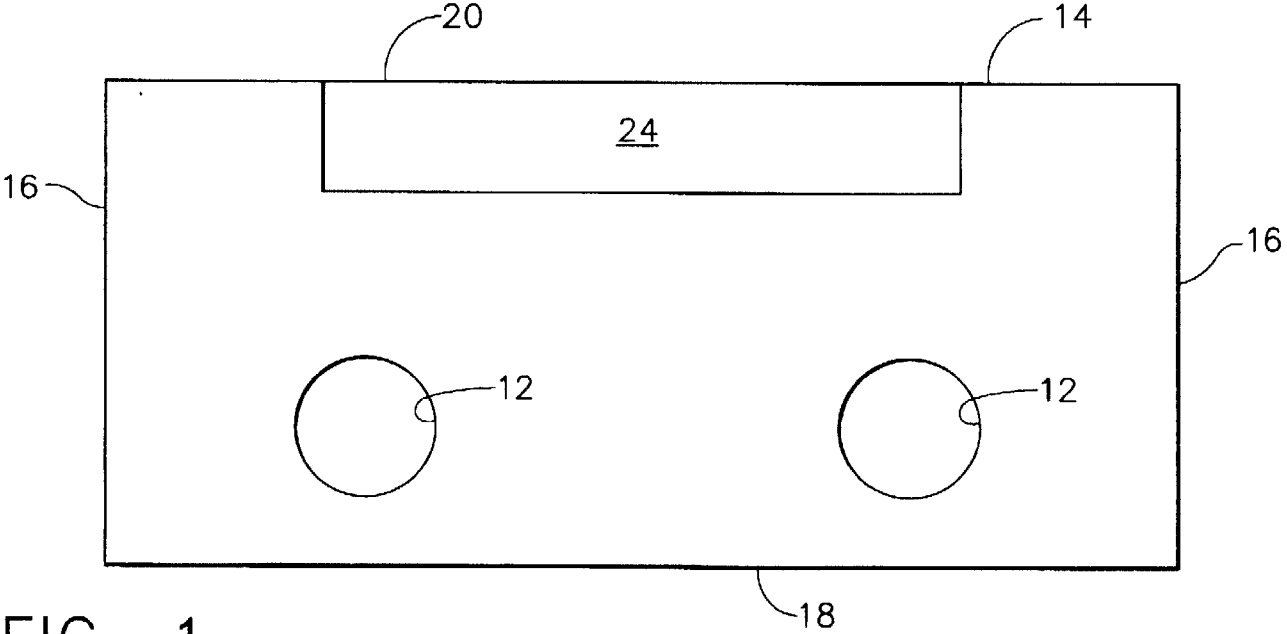
FIG. 1 is a front view of the tooling plate according to the present invention.

The present invention provides for an angled blade tool for use on a self-feeding continuous forming device, capable of forming closely spaced corrugations in fin material. Referring to the drawings, the blade tool 10 is typically a flat, rectangular plane, as illustrated in FIG. 1. The tooling 10 may be manufactured of any suitable material, typically a metal such as steel. As will be obvious to those skilled in the art, any suitable attachment means, such as apertures 12, can be incorporated into the tooling 10, for attaching the tool 10 to the fin machine.

Figure 2:
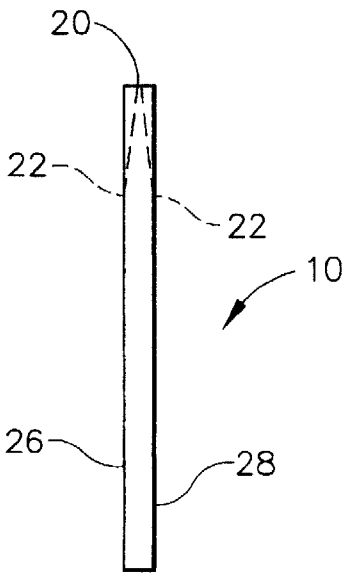
FIG. 2 is an end view of the plate of FIG. 1.

Continuing with the drawings, the tool 10 has a top edge 14, side or end edges 16, and a bottom edge 18. A blade portion 20 of the top edge 14 has been reduced to have a narrower thickness than the tool 10 overall. As illustrated in FIG. 2, the narrower edge portion 20 is achieved by providing a gradual and consistent reduction in thickness of the tool 10 from an interior point 22 of the plate 10 upward, so the blade is narrowest along portion 20 of top edge 14, thereby creating an angled blade area 24.

The substantially rectangular plane of metal 10 has a front side 26, and an opposing back side 28. The perimeter of the tool 10 is defined by top edge 14, bottom edge 18, and the pair of opposing side edges 16. Initially, each of the edges will have a uniform thickness, until the angled blade area 24 is created at the top edge 14, which is the edge that is to be applied to the fin material to form the folds which create the corrugations in the fin material. The angled surface is created on at least one side of the plane, and typically in a substantially mirror image on both the front and back sides of the tool 10. The angled surface 24 commences in an interior area of the plane, at point 22, in FIG. 2, which is below the top edge of the plane, and terminates at the top edge of the plane in a thickness approximately equal to the desired fold radius. Consequently, the thickness of the blade and the amount of angle required for angled surface 24 will vary, depending on the material thickness, the desired height of the formed fin product, and the desired number of fins per inch.

Figure 3:
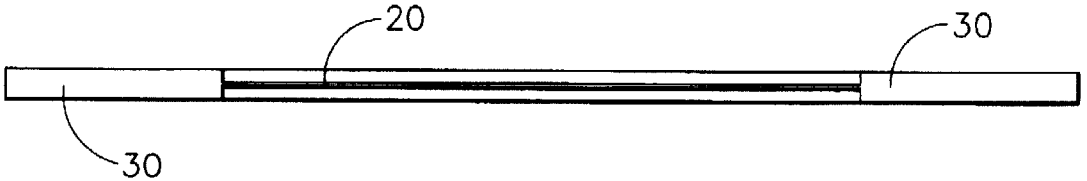
FIG. 3 is a top view of the plate of FIG. 1.

Referring now to FIG. 3, the top edge 14 comprises end areas 30, on either side of blade portion 20, which retain the same thickness as the overall tool 10. Retaining the tool thickness on both sides of the blade portion 20 allows the tool 10 to maintain strength. If, for example, the entire edge 14 consisted of the narrower angled blade, the strength of the tool 10 would be diminished, since the top edge 14 would, in such a situation, be flimsy as compared to the thicker remainder of the tool 10. Hence, the fin forming device according to the present invention provides for an angled surface capable of forming a plurality of folds in the fin material, each fold having a tighter radius than previously achievable in the prior art.

It is known that heat transfer ability of a fin material is directly related to surface area of the fin. As will be obvious to those skilled in the art, fin formed by a prior art tool, which tool has uniform thickness across its entire length and height, cannot possibly provide the heat transfer of fin formed using the angled blade tooling described and claimed herein. The closer spaced corrugations result in the fin product having an increased surface area, thereby increasing heat transfer capability. It is an advantage of the present invention that this increased surface area is provided without a corresponding decrease in the thickness of the material being formed into fins using the angled blade tooling of the present invention. As will be obvious to those skilled in the art, the thickness of the overall blade and the amount of angle required can vary, and will be based on the height and thickness of the fin material.

Having described the invention in detail and by reference to the preferred embodiment thereof, it will be apparent that other modifications and variations are possible without departing from the scope of the invention defined in the appended claims.

What is claimed is:

1. A fin folding apparatus for forming fin material into a plurality of corrugations, the apparatus comprising:

a reciprocating press fin machine for continuously forming a metal sheet into sinuous or corrugated fin material configuration using associated upper and lower opposed, metal-engaging dies, each movable toward and away from the other in a vertical forming stroke, and a first one of these dies also being movable in a limited stroke transverse to its vertical forming stroke; and a tool associated with the upper and lower opposed metal-engaging dies for forming the fin material, the tool comprising:

a blade with a substantially rectangular plane of metal having a front side, and an opposing back side, and further having a perimeter, the perimeter defined by a top edge, a bottom edge, and a pair of opposing side edges, each of the edges having an initially substantially similar thickness, and wherein the top edge is defined as the edge applied to the fin material to form a fold radius at each fold in the fin material, and an angled surface created on at least one side of the plane, commencing in an interior area of the plane below the top edge of the plane and terminating at the top edge of the plane, whereby an angled blade surface is created along at least a portion of the top edge of the plane, the angled blade surface having a narrower thickness than the initial edge thickness.

2. A fin forming apparatus as claimed in claim 1 wherein the angled surface comprises a first angled surface on the front side and a second angled surface on the back side, the second angled surface being substantially a mirror-image of the first angled surface.

3. A fin forming apparatus as claimed in claim 1 wherein the angled surface comprises a gradual and consistent reduction in thickness of the device from the interior area of the plane upward to the top edge.

4. A fin forming apparatus as claimed in claim 1 wherein the angled surface terminates at the top edge in a thickness approximately equal to the fold radius.

5. A method for folding fin material into a plurality of corrugations, the method comprising the steps of:

providing a substantially rectangular plane of metal having a front side, and an opposing back side, and further having a perimeter, the perimeter defined by a top edge, a bottom edge, and a pair of opposing side edges, each of the edges having an initially substantially similar thickness, and wherein the top edge is defined as the edge applied to the fin material to form a fold radius at each fold in the fin material;

creating an angled surface on at least one side of the plane, commencing in an interior area of the plane below the top edge of the plane and terminating at the top edge of the plane, whereby an angled blade surface is created along at least a portion of the top edge of the plane, the angled blade surface having a narrower thickness than the initial edge thickness.

6. A method for folding fin material as claimed in claim 5 wherein the angled surface comprises a first angled surface on the front side and a second angled surface on the back side, the second angled surface being substantially a mirror-image of the first angled surface.

7. A method for folding fin material as claimed in claim 5 wherein the angled surface comprises a gradual and consistent reduction in thickness of the device from the interior area of the plane upward to the top edge.

8. A method for folding fin material as claimed in claim 5 wherein the angled surface terminates at the top edge in a thickness approximately equal to the fold radius.

* * * * *